United States Patent [19]

Angele et al.

[11] Patent Number: 4,655,152

[45] Date of Patent: Apr. 7, 1987

[54] THREAD CLAMP FOR SEWING MACHINES

[75] Inventors: Eugen Angele; Ludwig Drechsel, both of Kaiserslautern, Fed. Rep. of Germany

[73] Assignee: Pfaff Industriemaschinen GmbH, Fed. Rep. of Germany

[21] Appl. No.: 859,328

[22] Filed: May 1, 1986

[30] Foreign Application Priority Data

May 4, 1985 [DE] Fed. Rep. of Germany ..... 3516046

[51] Int. Cl.[4] ..... D05B 53/00

[52] U.S. Cl. ..... 112/253; 112/285

[58] Field of Search ..... 112/253, 302, 296, 297, 112/298, 285

[56] References Cited

U.S. PATENT DOCUMENTS 3,614,006 10/1971 Pararra ..... 112/285

FOREIGN PATENT DOCUMENTS 534006 2/1941 United Kingdom ..... 112/253

*Primary Examiner*—Ronald Feldbaum

*Attorney, Agent, or Firm*—McGlew and Tuttle

[57] ABSTRACT

A thread clamp for sewing machines comprises a helical spring as a clamping element which is disposed in a bore extending crosswise to the feed direction of the work in a guide piece placed on the stitch plate. To obtain a very short closing path, the helical spring has in the region of the respective thread pull-off path windings whose mutual distance is greater than in the other regions. The helical spring is compressible by a setting drive for the fixed clamping of the threads.

7 Claims, 2 Drawing Figures

NF
V

THREAD CLAMP FOR SEWING MACHINES

FIELD AND BACKGROUND OF THE INVENTION

This invention relates in general to sewing machines and in particular to a new and useful thread clamp for sewing machines and to a sewing machine having a needle bar containing a plurality of needles which operates with threads which is guided by a thread clamp made up of a single coil spring having spaced apart thread guiding areas.

Through U.S. Pat. No. 840,887 a thread clamp with a helical spring as a clamping element on a sewing machine is known which is fastened in an arcuate deformation form at a cloth clamping frame of the sewing machine. It is held by a holding spring in the thread pull-off path. The arrangement is such that upon removal of the work the thread comes between the turns of the helical spring and the spring expands in its arc during pull off in the one direction due to the friction of the thread between two adjacent turns and thus becomes longer. With that the brake force acting on the thread decreases, so that the work can easily be removed.

If the thread is to be cut, it must be pulled off in the opposite direction and be moved against a knife. This causes the radius of curvature of the helical spring to become flatter, its length is shortned, and the turns move closer together. Hence the brake force is increased until the thread is completely clamped before it is cut.

The needle thread and the shuttle thread each have their own helical spring. While the thread clamp manages without a drive means for opening and closing, changing the direction of the thread pull-off is not possible in most sewing operations because of an increased use of the removal and stacking devices behind the sewing station or because of interconnection with subsequent sewing stations.

Helical springs are indeed superior to thread clamps consisting of single disks or jaws movable relatively to each other because of their cost effective manufacture as a thread clamping element, but because of their relatively long opening and closing path, they have not been used until now.

SUMMARY OF THE INVENTION

The invention provides a helical spring thread clamping element arranged so that it requires a very short opening and closing path and therefore the drive means can be dimensioned correspondingly small.

The helical spring developed according to the invention is especially advantageous for use in multi-needle sewing machines where closable thread clamps of a conventional type are hard to accommodate for lack of space. The helical spring is unobtrusively arranged in a space-saving and protected manner in the immediate region next to the path of the cutting knife.

Accordingly it is an object of the invention to provide an improved thread clamp for sewing machines which comprises a helical spring forming a clamping element which has spaced apart groups of coils which have wider spacing than the remaining coils and which are oriented in a guide so that the coil groups form pull-off guides for the winding threads.

A further object of the invention is to provide a sewing machine which includes means for advancing material past a reciprocating needle bar having a plurality of spaced needles and which includes a guide for the shuttle threads in the form of a continuous coil spring having spaced apart thread guiding areas formed with coils of wider spacing.

A further object of the invention is to provide a thread clamping sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific object attained by its uses, reference is made to the accompanying drawings and descriptive matter in which preferred embodiments of the invention are illustrated.

DESCRIPTION OF THE PREFFERED EMBODIMENTS

Figures 1, 2:
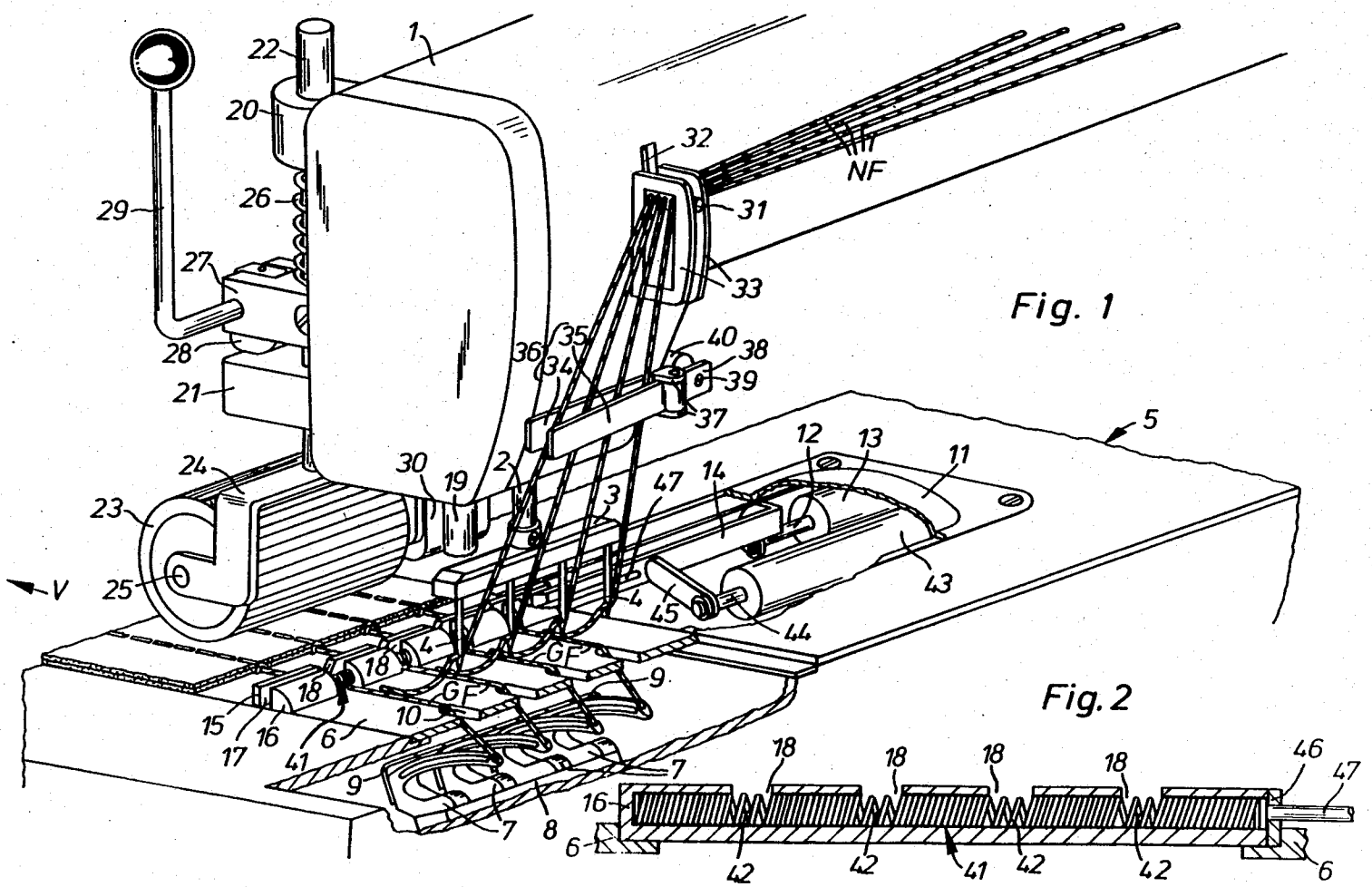
FIG. 1 is a perspective partial view of a four-needle chain stitch sewing machine shown at the end of a sewing process with a pull-off roll, a thread severing device, and the thread clamp according to the invention.
FIG. 2 is a sectional view of the helical spring disposed in a bore of a bar placed on the stitch plate, and its setting drive, on a larger scale.

Referring to the drawings in particular the invention embodied therein comprises a thread clamp for sewing machines which comprises a helical spring generally designated 41 forming a clamping element which is made up of a continuously coiled spring having spaced apart coiled areas with the coils having greater spacing through which the shuttle threads are guided.

The sewing machine is driven in the usual manner by a stop motor and may be equipped with a device for stopping in a certain position, e.g. in needle-up position.

Mounted in the head 1 of the sewing machine is the up-and-down moving needle bar 2, which carries at its lower end the needle holder 3, in which four thread carrying needles 4 are fastened. Cooperating with each needle 4 is a thread carrying double chainstitch shuttle 7, arranged in the work holding arm 5 under the stitch plate 6, for the formation of four parallel seams of stitch type 401 according to DIN 61400. The shuttles 7 are secured in a swingingly driven shuttle support 8 and can be exchanged. At each shuttle 7 is fastened a utter blade 9 for cutting the loops of needle threads NF taken up by the shuttle, or rather the leg of the loop leading to the work. For passage of the needle 4, the stitch plate 6 has longitudinal slits 10 which are so dimensioned that during sewing the threads do not come in contact with the cutting edge of the blades 9, but do so only at the end of the sewing process, when the work is being pulled off.

Under a cover plate 11 of the work carrying arm 5, spaced behind the needles 4, a cutting knife 14 for the shuttle threads GF, which is connected with the piston rod 12 of a a single-action pneumatic cylinder 13, is arranged; it is displaceable crosswise to the feed direction, arrow V, in a guide 17 formed by two guide bars 15,16 on the stitch plate 6. Guide bar 16 slopes obliquely upward in feed direction, so as not to hinder the sliding over the work. Each shuttle thread GF has its own entrance groove 18 traversing the guide bars 15,16 in feed direction. The usual presser foot on the presser bar 19 has been omitted in the interest of clearer illustration.

On the back side of head 1, two bearing pieces 20, 21 for the carrying rod 22 of a pull-off roll 23 is provided. The roll 23 is rotatable in a yoke 24 attached at the lower end of the carrying rod 22, with the shaft 25 mounted therein. The carrying rod 22 is pushed downwardly by a compression spring 26 disposed on it which braces at one end against the bearing piece 20 and at the other end against a fork 27 fastened on the carrying rod 22. For the raising and lowering of the carrying rod 22 with the pull-off roll 23 there is mounted in fork 27 a cam 28 which braces against the bearing piece 21 and can be actuated by a hand lever 29.

During sewing, the pull-off roll 23 is driven in the rhythm of stitch formation from the main shaft of the sewing machine via a known overriding clutch 30.

For the control of the needle threads NF, a thread take-up 31 connected with the needle bar 2 is provided, which is brought out through a slit 32 in the machine housing and is movable between two guards 33. Further there is provided on the front of head 1 a needle thread clamp 36 consisting of a one-armed fixed an a two-armed movable leg 34 and 35, respectively. The fixed leg 34 is secured on the machine housing and it comprises two angularly bent bars 37, between which the movable leg 35 is pivotably mounted. Connected with the arm 38 of leg 35 is the piston rod 39 of a pneumatic cylinder 40 disposed on the machine housing.

In a bore extending crosswise to the feed direction, (arrow V), in the guide bar 16 placed on stitch plate 6, directly next to the path of knife 14, a helical spring 41 is arranged as clamping element for the shuttle threads GF. The regions 42 of springs 41, disposed in the pull-off path of the shuttle threads GF which is determined essentially by the width of the entrance grooves 18, have, for the entrance of the shuttle threads GF at the end of a sewing process, turns spaced apart a greater distance than in the other regions. This results in a very short closing path for the tight clamping of the shuttle threads GF.

As setting drive for compressing the helical spring 41 a single action pneumatic cylinder 43 is used, on the piston rod 44 of which a pressure piece 45 is fastened which acts on spring 41 through a tappet 47 passed through the bore in a cover 46 which closes the bore of the guide piece 16.

The mode of operation is s follows:

The work, inserted under the presser foot (not shown) and under the roll-off roll 23, for example a waist band to be sewn to the upper edge of a pair of trousers, is transported in a feed direction (arrow V) for progressive seam formation by the pull-off roll 23 driven itermittently from the main shaft of the sewing machine via the overriding clutch 30. At the end of the seam the sewing machine is turned off and stopped in a needle-up position. The shuttles 7 will then have penetrated into the needle thread loops. For extraction of the threads to a length sufficient for the subsequent first stitch formation, the pull-off roll 23 is driven for a certain angle of rotation by an additional, known drive operating independently of the sewing machine. At a time to be selected according to the length of the needle threads NF to be pulled, during this partial rotation of the pull-off roll 23 occuring independently of the sewing machine drive The pneumatic cylinder 40 is pressurized and its piston rod 39 actuates the movable leg 35 of the needle thread clamp 36 counter to the action of a return spring, thus closing clamp 36 and fixing the needle threads NF. Consequently the needle threads NF are tensioned as the work moves on and are cut off at the blades 9 with the thread section leading to the work. After the pneumatic cylinder 40 has been vented, the thread clamp 36 is opened again by the return spring disposed in the cylinder housing.

In the further course of the partial rotation, the shuttle threads GF are guided into the entrance grooves 18 between pairs of adjacent turns in the regions 42 of the helical spring 41 and are extracted to the length required for the subsequent first stitch formation, which for technical reasons is greater than the length of the needle threds NF.

At the end of the partial rotation of pull-off roll 23, the pneumatic cylinders 43 and 13 are pressurized shortly one after the other in such a way that via the pressure piece 45 and tappet 47 first the helical spring 41 is compressed, whereby the shuttle threads GF are clamped fixed in the regions 42, and thereafter the piston rod 12(sic) the knife 14 is displaced counter to the force of a return spring in guide 17 crosswise to the feed direction (arrow V) the shuttle threads GF being severed. The guide piece 15, traversed by the entrance grooves 18, serves as counterknife to knife 14. By venting of the penumatic cylinder 13 the knife is then moved back into the starting position by the return spring disposed in the cylinder housing.

By renewed actuation of the pull-off roll 23 from the drive device 35 it is possible to transport the work after the severing of the threads without impedance onward, e.g. to a removal device connected after the pull-off roll 23.

The ends of the shuttle threads GF leading to the shuttles 7 remain clamped in the helical spring 41 until some initial stitches have been formed in the subsequent sewing process. By venting of the pneumatic cylinder 43, spring 41 is then relieved, it relaxes and lets go of the shuttle thread ends.

While specific embodiments of the invention have been shown and described in detail to illustrate the application of the principles of the invention, it will be understood that the invention may be embodied otherwise without departing from such principles.

What is claimed is:

1. A thread clamping for sewing machines comprising a helical spring clamp element having successive windings with spaced apart winding areas in which the windings have greater spacing therebetween than the remaining coil windings and define thread-clamps therebetween, a guide holding said spring in a position to define spaced apart thread pull-off guides at said winding areas, said spring having a variable length.

2. A thread clamp according to claim 1, wherein said guide comprises a member having openings at the spaced apart winding areas disposed transverse to the work feed direction, said guide having openings at the winding areas corresponding to the number of threads.

3. A thread clamp according to claim 2, wherein said helical spring is compressible and a drive member engageable with said spring to compress said spring.

4. In a sewing machine having a multiple number of thread needles which are movable upwardly and downwardly over a work area through which the material to be sewn is advanced, the improvement comprising a thread clamp disposed across the work area and comprising a housing having spaced apart openings of a number corresponding to the number of needles and aligned with said needles and including a clamping spring in said housing comprising a continuous coil spring having an area with spaced-apart thread clamping coils which are arranged at a greater spacing than the remaining portion of said spring.

5. In a sewing machine according to claim 4, including drive means engageable with the material ahead of said clamp for advancing the material to said clamp.

6. In a sewing machine according to claim 5, including a member engageable with an end of said spring for compressing and releasing said spring.

7. In a sewing machine according to claim 6, including a fluid pressure operated cylinder engageable with said member for moving said member to change the compression on said spring and including a thread cam mounted on said sewing machine including spaced apart members between which a plurality of threads are passed to said needles, and means for shifting said spaced apart member for varying the position of the threads which are moved therebetween.

* * * * *